US007944351B1

(12) United States Patent
Giallorenzi et al.

(10) Patent No.: US 7,944,351 B1
(45) Date of Patent: May 17, 2011

(54) LOW PROBABILITY OF DETECTION EMERGENCY SIGNALING SYSTEM AND METHOD

(75) Inventors: Thomas R. Giallorenzi, Sandy, UT (US); Eric K. Hall, Salt Lake City, UT (US); Michael D. Pulsipher, Syracuse, UT (US); Marc J. Russon, Salt Lake City, UT (US)

(73) Assignee: L-3 Communications Corp., New York, NY (US)

( * ) Notice: Subject to any disclaimer, the term of this patent is extended or adjusted under 35 U.S.C. 154(b) by 526 days.

(21) Appl. No.: 12/350,096

(22) Filed: Jan. 7, 2009

(51) Int. Cl.
*G08B 1/08* (2006.01)

(52) U.S. Cl. ..... 340/539.11; 375/130

(58) Field of Classification Search ..... 340/539.11, 340/539.13, 539.14, 539.21, 539.24; 370/468, 370/478; 375/130, 132
See application file for complete search history.

(56) References Cited

U.S. PATENT DOCUMENTS

| | | | | |
|---|---|---|---|---|
| 5,157,688 | A * | 10/1992 | Dell-Imagine | 375/130 |
| 5,929,777 | A | 7/1999 | Reynolds | |
| 6,545,606 | B2 | 4/2003 | Piri et al. | |
| 6,567,420 | B1 | 5/2003 | Tiedemann, Jr. et al. | |
| 6,574,267 | B1 | 6/2003 | Kanterakis et al. | |
| 6,954,482 | B2 * | 10/2005 | Mills et al. | 375/132 |
| 7,148,802 | B2 | 12/2006 | Abbruscato | |
| 7,301,453 | B2 | 11/2007 | Fry | |
| 7,593,531 | B2 * | 9/2009 | Lau et al. | 380/263 |
| 2002/0067757 | A1 | 6/2002 | Philips et al. | |
| 2005/0039103 | A1 | 2/2005 | Azenko et al. | |
| 2006/0194547 | A1 | 8/2006 | Davis | |
| 2006/0270442 | A1 | 11/2006 | Miller et al. | |

* cited by examiner

*Primary Examiner* — John A Tweel, Jr.
(74) *Attorney, Agent, or Firm* — Kirton & McConkie; William T. Ralston

(57) ABSTRACT

An emergency locating system can include emergency transceivers and rescue transceivers. The emergency transceivers can be capable of repeat transmission of a distress message using a variable power level and variable spreading factor. A receive transceiver can be capable of receiving the distress messages and sending a confirmation message to the emergency transceiver. The emergency transceiver can be capable of receiving the confirmation message and terminating transmission of the distress message.

30 Claims, 6 Drawing Sheets

LOW PROBABILITY OF DETECTION EMERGENCY SIGNALING SYSTEM AND METHOD

FIELD

The present application relates to wireless communications. More particularly, the present application relates to techniques for using a low-probability of detection waveform for emergency signaling.

BACKGROUND

There are many instances where it would be useful to provide the ability to easily, yet covertly, summon aid to a person in distress. A particularly poignant example is in military operations, where pilots can be shot down, foot soldiers may be cut off from their units, and similar situations.

In civilian situations, GPS-enabled cell phones can fill this need, allowing for a 911 call to both place the distress person in contact with emergency personnel as well as transmitting location information via the enhanced 911 system capabilities. Unfortunately, cell phone coverage is not always available, and GPS operation is inhibited in some situations. For example, GPS can operate poorly underground, when shielded by dense foliage, or in highly built up urban areas. Cell phones are also somewhat bulky and cumbersome to operate. Moreover, cellular coverage is not uniformly available, and can fail in disaster situations. In a hostile environment, both GPS and cellular operation can also be jammed, making them unavailable.

Further difficulties can also be presented in hostile situations. A cell phone transmission or simple distress beacon transmission can be used by both friends and foes alike to locate the person in distress, and can result in the leading of hostile forces directly to the person in distress. Equipment can fall into hostile hands, and be used for nefarious purposes (e.g., transmission of false distress signals to lure rescuers into an ambush, interception of legitimate distress signals, etc.).

Depending on the scenario, rescuers may be nearby and quick to provide aid (e.g., the separated foot soldier scenario) or rescuers may be a long distance away and unable to render assistance for some time (e.g., the downed pilot scenario). As distress signaling equipment is likely to be battery powered, low power consumption may therefore be desirable to allow for extended operation time.

Accordingly, there remains a need for emergency signaling techniques that are suitable for use in hostile environments.

SUMMARY

Accordingly, systems and techniques for transmitting a low probability of detection distress message have been developed.

In some embodiments of the invention, a method of transmitting an emergency distress signal can include maintaining a low probability of detection profile. The method can include detecting an emergency indication at an emergency transmitter and transmitting a first low probability of detection encoded radio frequency spread-spectrum signal in response to the emergency indication. The first low probability of detection encoded radio frequency spread-spectrum signal can use a first power level and a first spreading factor selected to provide a local communications range. The method can also include waiting a time interval for reception of a confirmation message at the emergency transmitter in response to the first low probability of detection encoded radio frequency spread-spectrum signal. If a confirmation message is not received, the method can include transmitting a second low probability of detection encoded radio frequency spread-spectrum signal using a second power level. The second power level can be greater than the first power level to provide an extended communications range greater than the local communications range.

In some embodiments of the invention, an emergency locating system can include one or more emergency transceivers and one or more rescue transceivers, each capable of transmitting and receiving spread spectrum signals. The emergency transceiver(s) can include a transmitter configured to transmit a distress message that includes a unique unit identification. The emergency transceiver(s) can also include a receiver capable of controlling transmitter power level and spreading factor based on the reception and non-reception of confirmation messages. The rescue transceiver(s) can include a receiver configured to receive distress messages and transmitters configured to transmit a confirmation message in response to the reception of a distress message.

In some embodiments of the invention, a portable emergency transceiver can include a wearable device having an actuator, a transmitter, and a receiver. The actuator can be operatively coupled to the transmitter to transmit a distress message when the actuator is activated. The transmitter can be capable of repeated transmission of a unique unit identification with a variable power level and a variable spreading factor. The receiver can be capable of receiving confirmation messages and controlling the variable power level and variable spreading factor based on the reception and non-reception of confirmation messages.

BRIEF DESCRIPTION OF THE DRAWINGS

Additional features and advantages of the invention will be apparent from the detailed description which follows, taken in conjunction with the accompanying drawings, which together illustrate, by way of example, features of the invention; and, wherein.

DETAILED DESCRIPTION

Figure 1:
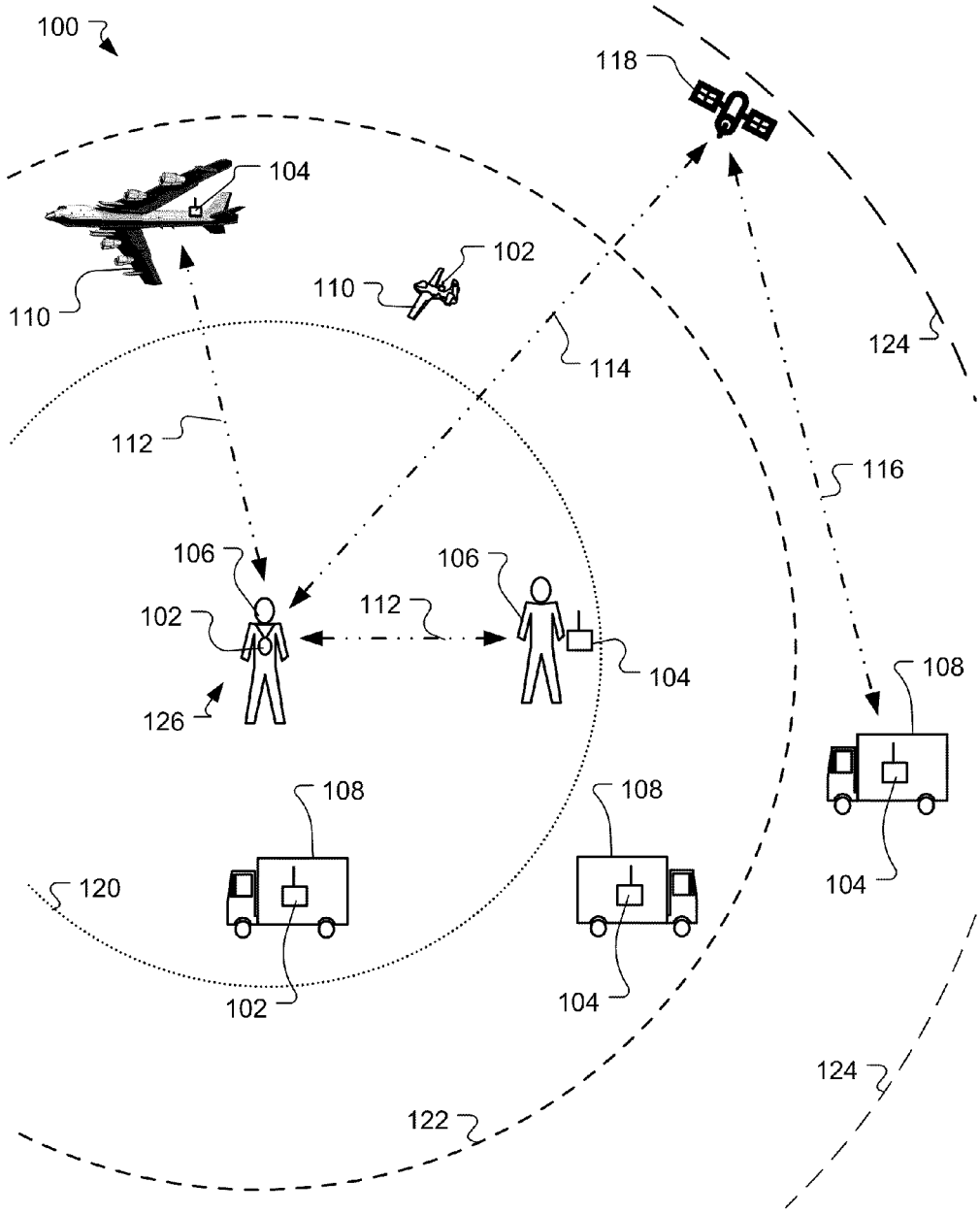
FIG. 1 is a block diagram of a search and rescue system in accordance with some embodiments of the present invention.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

In describing the present invention, the following terminology will be used:

The singular forms "a," "an," and "the" include plural referents unless the context clearly dictates otherwise. Thus, for example, reference to a transmission includes reference to one or more transmissions.

As used herein, the term "about" means quantities, dimensions, sizes, formulations, parameters, shapes and other characteristics need not be exact, but may be approximated and/or larger or smaller, as desired, reflecting acceptable tolerances, conversion factors, rounding off, measurement error and the like and other factors known to those of skill in the art.

By the term "substantially" is meant that the recited characteristic, parameter, or value need not be achieved exactly, but that deviations or variations, including for example, tolerances, measurement error, measurement accuracy limitations and other factors known to those of skill in the art, may occur in amounts that do not preclude the effect the characteristic was intended to provide.

Numerical data may be expressed or presented herein in a range format. It is to be understood that such a range format is used merely for convenience and brevity and thus should be interpreted flexibly to include not only the numerical values explicitly recited as the limits of the range, but also as including all the individual numerical values or sub-ranges encompassed within that range as if each numerical value and sub-range is explicitly recited. As an illustration, a numerical range of "about 1 to 5" should be interpreted to include not only the explicitly recited values of about 1 to 5, but also include individual values and sub-ranges within the indicated range. Thus, included in this numerical range are individual values such as 2, 3, and 4 and sub-ranges such as 1-3, 2-4, and 3-5, etc. This same principle applies to ranges reciting only one numerical value and should apply regardless of the breadth of the range or the characteristics being described.

As used herein, a plurality of items may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Now, returning to the discussion introduced above, it has been recognized by the present inventors that there is a need for emergency signaling techniques that can provide for covert operation. In other words, a covert distress signal is one that can be detected by authorized users of the system, but is difficult to detect or intercept by an authorized user. Accordingly, in some embodiments of the present invention, a search and rescue system has been developed that is suitable for use in hostile environments. The system can include a range-adaptable emergency transceiver which can establish two-way communications using a low-probability (LPD) of detection waveform. Power and rate control can be used to maintain a minimum LPD profile while successively expanding communications range from the emergency transceiver until a confirmation message is received.

In some embodiments of the present invention, spread-spectrum waveforms can be used. Spread spectrum waveforms, in addition to enhancing the ability to perform ranging, also provide benefits in enabling covert systems which can be helpful in military applications. Application of layered spreading codes, as described in further detail below, can provide for low complexity receivers even when high spreading factors (e.g., 30 dB or greater, or 40 dB or greater) are used. Layered codes can allow both emergency transceivers and locator transceivers to be implemented using lightweight, battery-powered devices. Additional security can also be provided by including authorization codes that are entered to enable transmissions from the emergency transceivers and locator transceivers.

FIG. 1 illustrates a search and rescue system in accordance with some embodiments of the present invention. The system, shown generally at 100, can include a plurality of emergency transceiver units 102, and a plurality of rescue transceiver units 104. For example, emergency transceiver units can be associated with (e.g., worn by) individual personnel (e.g., 106) and/or deployed on system assets (e.g., vehicles 108, aircraft 110, etc.). Similarly, rescue transceiver units can similarly be associated with (e.g., worn or carried by) individual personnel and/or deployed on system assets (e.g., vehicles, aircraft, etc.). Communications between the emergency transceiver units and rescue transceiver units can be direct (e.g., 112) or relayed (e.g., 114, 116), for example via a satellite 118.

The emergency transceivers 102 can be capable of transmitting one or more distress messages when activated by a user. The transmission can be made using a low probability of detection radio frequency waveform. For example, the low probability of detection radio frequency waveform can be a spread spectrum waveform which uses a variable power level and a variable spreading factor, for example as described further below. Spread spectrum waveforms can include a code sequence, which makes is difficult for an unauthorized user that does not know the code sequence to detect, demodulate, triangulate on, or otherwise exploit the waveform. In contrast, for an authorized user who knows the code sequence, detection of the waveform is much less difficult.

The rescue transceivers 104 can be capable of receiving the distress message and transmitting a confirmation message in response to reception of the distress message. If no confirmation message is received, the distress message can be retransmitted. Retransmission can be performed, increasing the power level and/or spreading factor, until a response is received.

Figure 2:
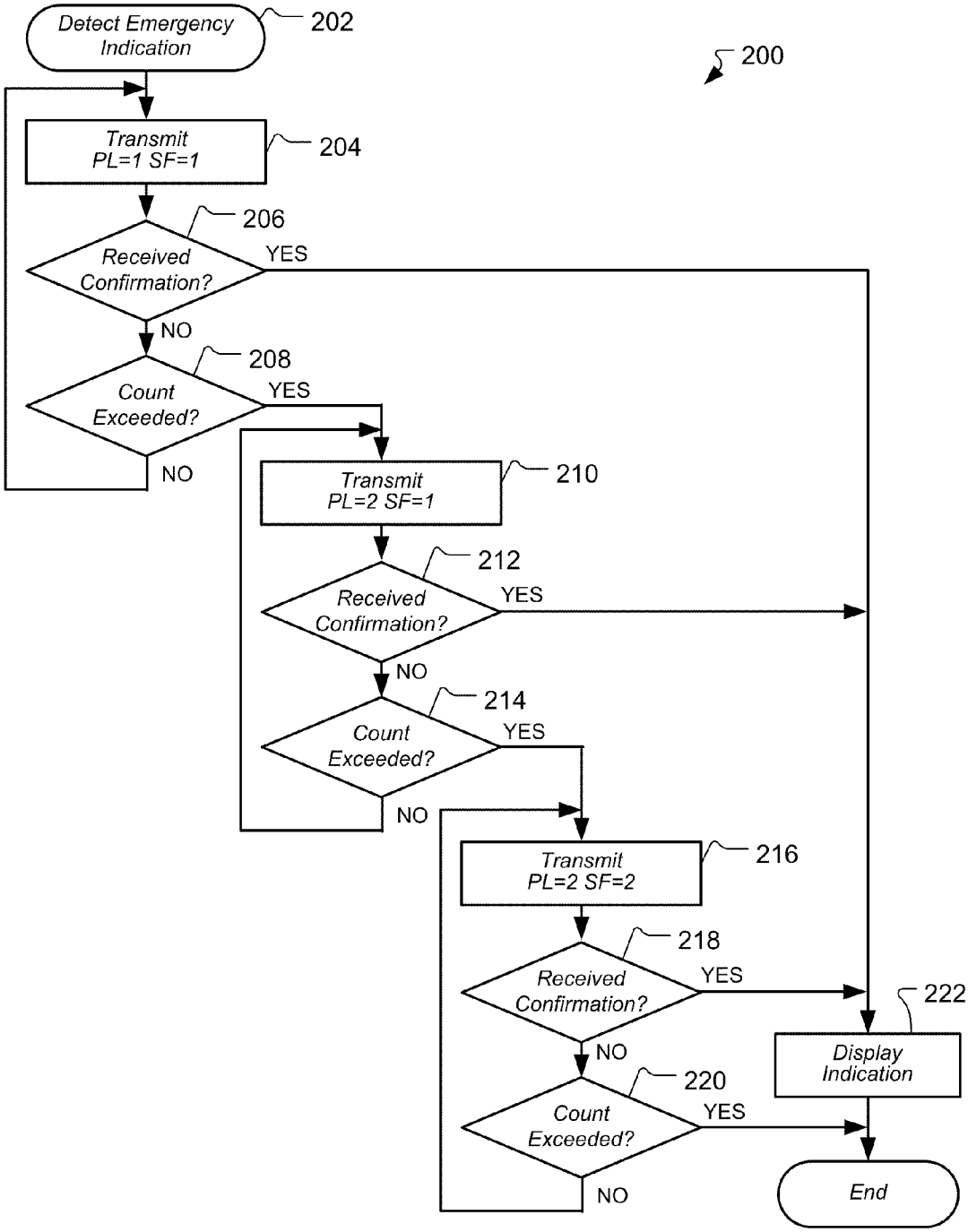
FIG. 2 is a flow chart of a process for transmitting distress messages in accordance with some embodiments of the present invention.

FIG. 2 illustrates a flow chart of operation of an emergency transceiver in accordance with some embodiments of the present invention. The process, shown generally at 200, begins when an emergency indication is detected at the emergency transmitter at block 202. For example, an emergency indication can be created by a user operating an actuator such as a push button, multiple push buttons, a watch stem, rotating a watch bezel, and similar actions or combinations or actions. As another example, an emergency indication can be signaled by an environmental sensor automatically (e.g., chemical, radiation, or acceleration sensor).

A first LPD encoded transmission is made in response to the emergency indication using a first power level (P=1) and a first spreading factor (SF=1) at block 204. For example, the first power level and first spreading factor can provide a local communications range. A time interval is waited for reception of a confirmation message at block 206, and a decision made based on whether reception is made. If a confirmation message is received, the process can terminate, although additional operations can be provided, such as for example, providing a human-perceivable indication at block 222. For example, a human-perceivable indication can be an audible, visible, or haptic signal or combination thereof.

If no confirmation message is received, the transmission at block 204 can be repeated. For example, at block 208, a repeat count can be checked. For example, the transmission can be repeated 1, 2, 3, or some other predefined number of times if no response is received within a time interval after each transmission. By way of example and not limitation, repeating the transmissions can be beneficial in improving the probability that the distress message is received by an emergency transceiver which is within range when noise, interference, or other factors might cause some transmissions to be missed.

After a predefined number of transmissions have occurred with no response, transmission can be made using a second power level (PL=2), wherein the second power level is greater than the first power level at block 210. The second power level can provide an extended communications range greater than the local communications range. At block 212, if a confirmation is received, the process can terminate as described above. If no confirmation is received, block 210 can be repeated up to a predetermined number of times. (The number of repeats allowed by block 214 can be the same as or different from the number of repeats allowed by block 208).

If no confirmation message has been received after a predefined number of repeats of block 210, another transmission using the second power level and a second spreading factor (SF=2) can be made at block 216, wherein the second spreading factor is greater than the first spreading factor. The second spreading factor can provide a global communications range which is greater than the extended communications range. For example, the first spreading factor can use a first chipping rate and a first data rate, and the second spreading factor can use the first chipping rate and a second data rate, wherein the second data rate is less than the first data rate. In other words, the second spreading factor can correspond to a lower data rate than the first spreading factor. Lower data rates result in longer bit transmission times, providing a higher energy per bit, which in turn provides for a longer range over which communication can occur.

If a confirmation message is received at block 218, the process can terminate as described above. If no confirmation message is received, block 216 can be repeated a predetermined number of times. (The number of repeats allowed by block 220 can be the same as or different from the number of repeats allowed by block 214).

Although not shown in FIG. 2, if no response has been received after block 216 has been repeated a predefined number of times, additional transmissions using other power levels and/or other spread factors can be performed in a similar manner as just described. Also, although not shown in FIG. 2, between the loop iterating block 210 and the loop iterating block 216, additional transmissions can be performed using the first spread factor and other power levels.

The interval between transmissions can also be varied. In other words, blocks 206, 212, 218 need not each wait a constant interval to receive a confirmation message—the interval can be varied between each repeat. For example, the interval can be varied psuedorandomly. By way of example and not limitation, a pseudorandom repeat interval can help to make it more difficult to detect, intercept, and or locate the distress transmissions by an unauthorized user.

In general, it will now be appreciated, that the process 200 can include a number of different loops where transmissions are performed using different or similar power levels and spread factors. Typically, the power level and/or spread factor will be increased after one or more transmissions at each power level and/or spread factor to successively expand the communications range until a confirmation message is received. Accordingly, the process can help to ensure that the minimum power is used helping to keep the (unauthorized) detection probability as low as possible, while quickly establishing communications between the emergency transceiver and a rescue transceiver.

Figure 3:
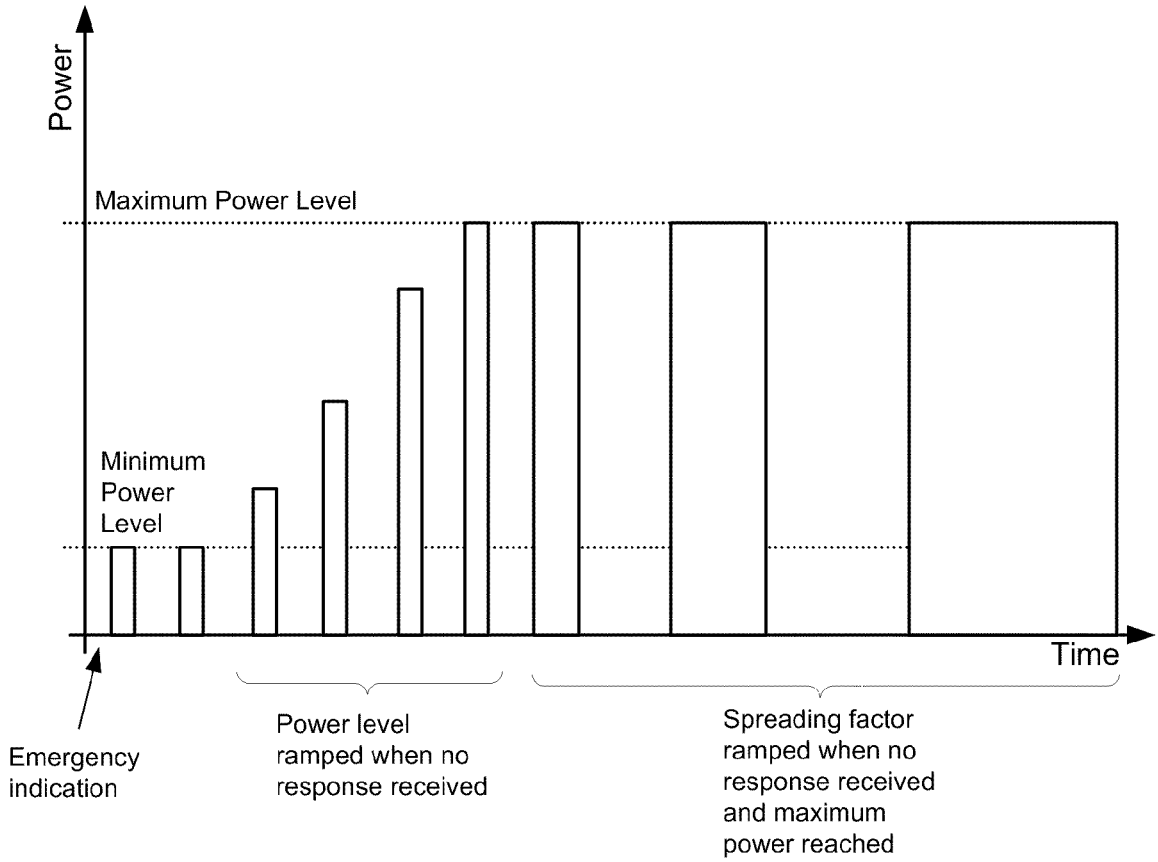
FIG. 3 is a graph showing a series of transmissions from an emergency transceiver in accordance with some embodiments of the present invention.

FIG. 3 provides one illustration of distress transmissions from an emergency transceiver. It can be seen that the power level is ramped up as no response is received to transmissions until a maximum power level is reached. After the maximum power level is reached, the spreading factor is ramped up (data rate is ramped down), until a maximum spreading factor is reached. Actual data rates, power levels, and spreading factors can be varied depending on other implementation constraints. The differences in power level and spreading factors can, however, enable covering a wide range (e.g., 20 dB or greater, 30 dB or greater, or 40 dB or greater) in the link performance (e.g., 10 mW transmit power at 1 kb/s data rate as compared to 1 W at 10 b/s is a difference of 40 dB).

Returning to FIG. 1, relative to a specific user 126, range can be successively expanded from a local range 120 to an extended range 122, to a global range 124 by increasing power and/or spreading factor in some embodiments. As a specific example, in some embodiments, the local communications range can correspond to ground-to-ground communications within a distance of about 5 km (although a greater or lesser communications range can be provided). The extended communications range can correspond to ground-to-air communications within a distance of about 500 km (although a greater or lesser communications range can be provided). The global communications range can correspond to a ground-to-space communications range within a distance of about 50,000 km (although a greater or lesser range can be provided). The ranges provided in a particular implementation are a function of the transceiver characteristics, power levels, spreading factors, operating environment, and other factors. In addition, while three different ranges are illustrated, a fewer or greater number of transmission parameter sets (power level, spread factor) can be provided to result in a fewer or greater number of different communications ranges.

An additional benefit of slowly expanding the communications range of the emergency transceiver is that reception of the distress message tends to be localized to rescue transceivers located closest to emergency transceiver. This can help to increase response time of rescuers and can help to conserve battery power. For example, other personnel or equipment that can quickly respond are likely to be in the local range; in contrast a global range can include personnel or equipment that are many hours away.

The distress transmissions can be spread spectrum encoded to help provide a low probability of detection. For example, the distress transmissions can be direct sequence spread spectrum encoded. As a more particular example, the distress transmissions can use a layered direct sequence code. Direct sequence coding can provide benefits in simplifying the implementation of a direct sequence spreading and despreader as described further below.

Figure 4:
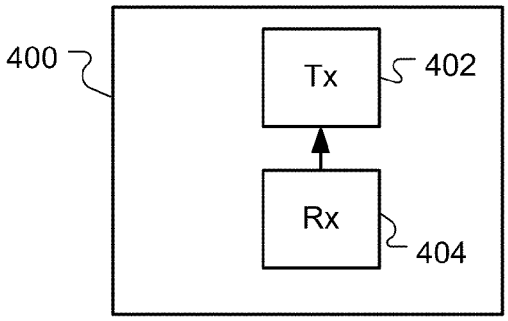
FIG. 4 is a block diagram of an emergency transceiver in accordance with some embodiments of the present invention.

FIG. 4 provides a block diagram of an emergency transceiver in accordance with some embodiments of the present invention. The emergency transceiver, shown generally at 400, can include a transmitter 402 capable of repeated transmission of a unique unit identification using a LPD radio frequency waveform. The LPD radio frequency waveform can use a variable power level and a variable spreading factor. For example, the LPD radio frequency waveform can use a fixed chipping rate and a variable data rate, allowing a variable spreading factor.

The emergency transceiver 400 can also include a receiver 404 interfaced to the transmitter 402. The receiver can be capable of reception of confirmation messages via a radio frequency link. The receiver can operate on the same frequency or a different frequency from the transmitter. The receiver can control the variable power level and variable spreading factor based on reception and/or non-reception of confirmation messages. For example, the receiver can initiate the transmitter at intervals while increasing the variable power level until a confirmation is received or a maximum power level is reached. Once the maximum power level is reached, the receiver can initiate the transmitter at intervals while increasing the variable spreading factor until a confirmation message is received or a maximum spreading factor is reached. The receiver can increase at least one of the power level and the spreading factor after a predetermined number of transmissions has occurred and no confirmation message has been received. The interval between transmissions can be varied, for example using a pseudo random interval.

In other words, the receiver can ramp up the power level and/or spreading factor, until a response is received or the maximum power and maximum spreading factor are received. The power level and spreading factor can be continuously varied or can be changed among a number of discrete steps. For example, the power level and variable spreading factor can be controlled according to a process as described above in relation to FIG. 2.

While the inclusion of both a receiver and transmitter in the emergency transceiver increases complexity somewhat relative to a simple beacon transmitter, a two-way communications capability can provide a number of benefits. The inclusion of the receiver enables the above-described process of gradually increasing power level and spreading factor, since it is possible to ascertain when the distress transmission has been received (e.g., based on the reception of the confirmation message). Because the confirmation messages confirms that the distress message has been received, only as many transmissions as necessary to be heard can be sent, helping to prolong battery (or other power source) lifetime (as opposed to continuous beacon-only operation). Another benefit of is that two-way ranging can be performed. For example, round trip time delay can be measured between the emergency transceiver and the rescue transceiver, allowing the distance between the units to be measured.

Figure 5:
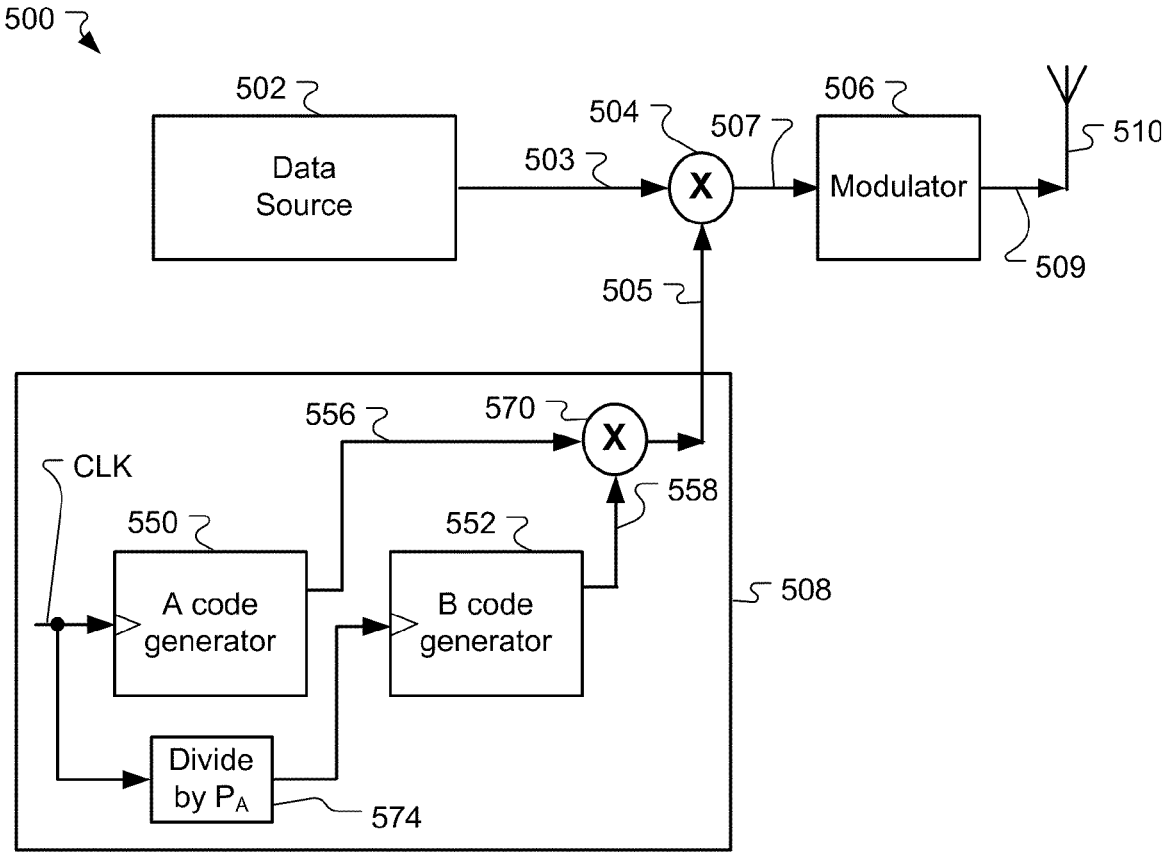
FIG. 5 is a block diagram of a transmitter suitable for use in some embodiments of the emergency transceiver.

FIG. 5 provides a block diagram of a transmitter 500, suitable for use in some embodiments of the emergency transceiver. The transmitter can include a data source 502, a spreader 504, a modulator 506, spreading code generator 508, and an antenna 510. The data source supplies data 503 for transmission. For example, the data source can provide a unique unit identification that is transmitted as a part of the distress signal. The unique unit identification can be used to identify the emergency transceiver (or associated user) from which the distress signal originated. For example, the unique unit identification can be determined based on a predefined authorization methodology as exampled further below.

Data 503 output from the data source 502 can be spread using the spreader 504 (e.g., a multiplier, exclusive-or gate, or similar device) with a spreading code 505 from the spreading code generator 508. The resulting spread signal 507 can be modulated using the modulator 506 to form a radio signal 509 transmitted using the antenna 510. For example, the modulator can include a signal generator with a direct modulation input, the modulator can include a baseband modulator and a frequency upconverter, or other arrangements of components.

The spreading code generator 508 can form a relatively longer AB spreading code from two relatively shorter component codes: an A code and a B code. The AB code is produced using two sub-code generators 550, 552, which produce respectively an A code 556 having length PA, and a B code 558 having length PB. The A-code generator is clocked at the chip rate, and thus the A code repeats every PA chips. The B-code generator is clocked at 1/PA of the chip rate through a divider 574, and thus the B code repeats every PA*PB chips, but only changes after every PA chips. The component codes are combined with a multiplier (exclusive OR) 570. By multiplying the A-code and the B-code together, the AB code 506 is obtained which changes every chip, and repeats every PA*PB chips.

While two levels of code are sufficient to create a layered code, more levels can be used by adding additional stages, duplicating multiplier 570, divider 574, and providing additional code generators.

The resulting code can be described in terms of the individual chips of the component sub-codes as follows. Designating the chips of the A-code as $A_1 \ldots A_{PA}$ and the chips of the B-code as $B_1 \ldots B_{PB}$, the resulting code sequence can be expressed as: $A_1B_1$, $A_2B_1$, $A_3B_1 \ldots A_{PA}B_1$, $A_1B_2$, $A_2B_2$, $A_3B_2, \ldots A_{PA}B_2, A_1B_3 \ldots A_{PA}B_{PB}$. The resulting code can be used for direct-sequence spreading by, for example, exclusive or-ing the code with data to be transmitted (e.g. with spreader 504), modulation a carrier with the code, or other appropriate arrangements. Layered spreading codes can be applied in a spread spectrum transmitter used in either the emergency transceiver, the rescue transceiver, or both, in accordance with some embodiments of the present invention. Layered spreading codes can be beneficial in allowing for long codes to be developed using short codes, and simplifying reception when high processing gain is used, for example, as described further below.

Figure 6:
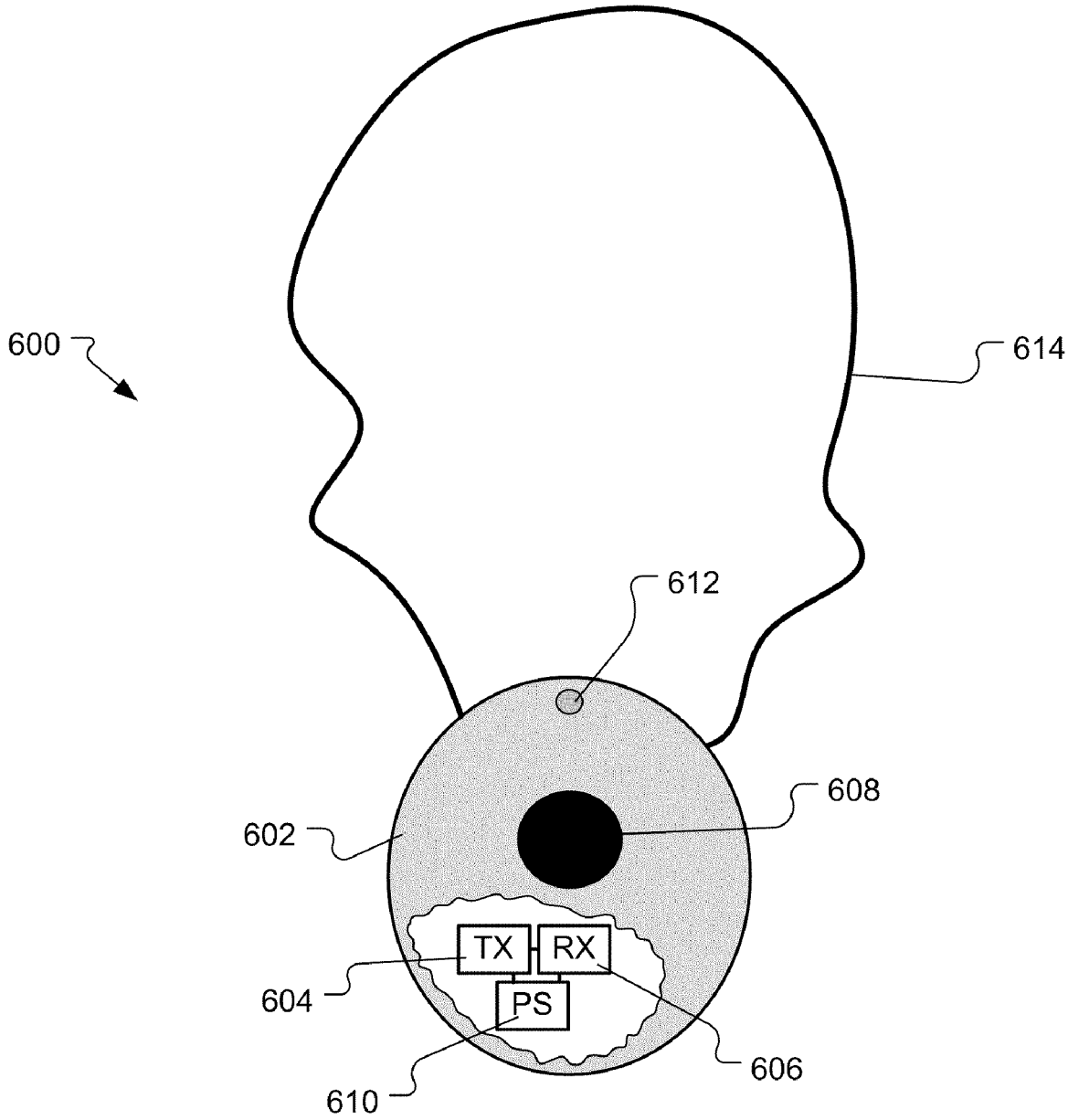
FIG. 6 is an illustration of an emergency transceiver in accordance with some embodiments of the present invention.

An emergency transceiver can be packaged in various arrangements. For example, FIG. 6 illustrates an emergency transceiver 600 packaged into an enclosure 602 in the form of a pendant. As other examples, the emergency transceiver can be packaged in a watch, jewelry item (e.g., a pin or broach), identification card or badge, insignia (e.g., a sewn-on patch), car remote, or embedded in equipment, such as a weapon or clothing (e.g., a button).

The enclosure 602 can enclose a transmitter 604 and a receiver 606 (illustrated in a cutaway portion of the enclosure), for example as described above in conjunction with FIG. 4. The enclosure can include an actuator 608, such as a push button, watch stem, watch bezel, or the like. The actuator can initiate transmission of a distress message. For example, operation of the actuator according to a predefined authorization sequence can initiate transmission of the distress signal. As examples, predefined authorization sequences can a sequence of push button inputs (e.g., a pattern of long and short presses, a pattern of a number of presses separated by pauses, or similar arrangements). If more than one actuator is provided, such as for example, multiple push buttons, the authorization sequence can be a sequence of one or multiple button presses (e.g., as for a cipher lock). A watch bezel can be operated in a manner similar to a combination lock or other manners to enter an authorization sequence.

Use of an authorization code can prove helpful in situations where the emergency transceiver could fall into the hands of an adversary, such as a military situation. For example, without an authorization code, a captured emergency transceiver could be used by hostile forces to lure friendly forces into an ambush. Inclusion of an authorization code can also prove helpful in other situations to avoid unauthorized uses of the emergency transceiver.

Use of an authorization code can also allow for identification of a particular user or particular emergency transmitter. For example, authorization codes can be associated with individuals, and used to generate the unique unit identification information. For example, each user can be given a unique authorization code or unique portion of an authorization code.

The emergency transceiver 600 can also include a power source 610. For example, the power source can be a solar panel, a battery, a fuel cell, a kinetic energy converter (e.g., a self-winding watch mechanism or hand crank).

The emergency transceiver 600 can include an indicator 612 which can be used to display an indication to the user that a ranging command has been received. This can help to provide reassurance to the user that the distress transmission has been received. Various indicators can be used, including for example, a visual indicator (e.g., a light), a haptic indicator (e.g., a vibrator), an audible indicator (e.g., a speaker), or other user-perceivable indicators or combinations of indicators. Such an indication can be of comfort to the distressed user.

The emergency transceiver 600 can include one or more antennas. For example, the emergency transceiver can share an antenna between the transmitter 604 and receiver 606, for example, using an antenna switch (not shown). The antenna can be disguised as a portion of the wearable apparatus used to wear the emergency transceiver, such as a lanyard 614, as shown. As other examples, the antenna can be disguised as or in a chain, wristband, or other feature. As another example, the antenna can be all or a portion of the enclosure 602.

The emergency transceiver can also include components (not shown) such as upconverters, downconverters, modulators, mixers, demodulators, frequency references, code generators, spreaders, despreaders, filters, processors, and similar components used in transmitters and receivers. Portions of the transmitter and receiver in the emergency transceiver can also be common or shared.

Figure 7:
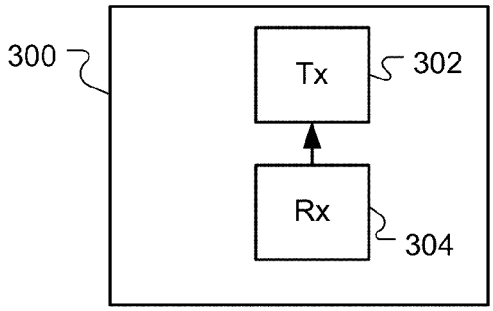
FIG. 7 is a block diagram of a rescue transceiver in accordance with some embodiments of the present invention.

Turning to FIG. 7, a block diagram of a rescue transceiver is illustrated. The rescue transceiver 300 can include both a receiver 304 and a transmitter 302. The receiver can be capable of receiving a distress message from an emergency transceiver. The receiver can be interfaced to the transmitter, and capable of initiating the transmission of a confirmation message by the transmitter in response to the reception of a distress message by the receiver.

The rescue transceiver can be packaged similarly as to the emergency transceiver. Alternatively, the rescue transceiver can be packaged as a handheld unit, installed in a vehicle or cockpit, or packaged in any other suitable manner.

Transmission from the emergency transceiver to the rescue transceiver can use the same waveform as transmission from the rescue transceiver to the emergency transceiver. The emergency transceiver and the rescue transceiver can use the same code. The waveform can include the use of layered spreading codes, as described above.

Figure 8:
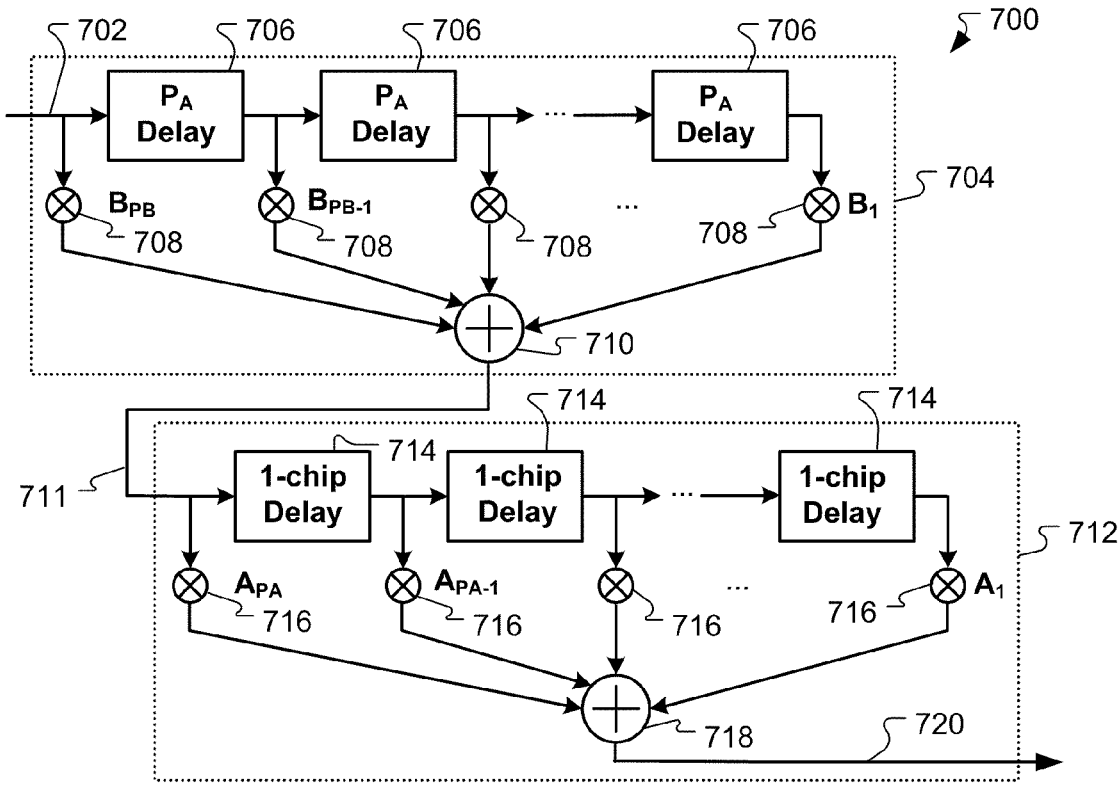
FIG. 8 is a block diagram of a despreader suitable for use in an emergency transceiver receiver or a rescue transceiver receiver in accordance with some embodiments of the present invention.

FIG. 8 illustrates a block diagram of a despreader 700 suitable for use in a receiver (e.g., an emergency transceiver receiver 404 or a rescue transceiver receiver 304) for detecting a layered code transmission (e.g., a distress message or a confirmation message) in accordance with some embodiments of the present invention. The input 702 to the despreader can be, for example, a complex baseband digitized signal. The despreader can include two correlation sections 704, 712, corresponding to each of the component sub-codes. The first section 704 can include a tapped delay line formed by a series of delay units 706 each providing a delay of $P_A$ chips. As described above, the A-code code repeats every $P_A$ chips, hence, for a properly time-aligned input signal, only the B-code portion of the input signal chips are different between each delay unit. Hence, the outputs of the tapped delay line can be multiplied by the B code using multipliers (exclusive ORs) 708, and then summed in a summer 710. The resulting output 711 from the first section has thus had the B code removed.

The second section 712 uses a tapped delay line with delay units 714 having delays of one chip time and, using multipliers 716 and a summer 718, correlates against the A code to form the final correlation result 720.

Codes with more layers can be accommodating by adding additional sections to the despreader, like the first section 704, using appropriate delays in delay lines similar to the delay lines 706 shown here and appropriate code multiplications similar to the multipliers 708 shown here.

This structure is considerably simpler than a conventional correlator for a non-layered code. For example, a code of length 10,000, a conventional correlator would require 10,000 coefficient storage locations and multipliers. In addition, for each input chip coming in, a sliding correlation would require performing 10,000 multiply-accumulate operations. In contrast, a layered code of length 10,000 can be formed using two component codes of length 100. Thus, 200 coefficient storage locations and multipliers can be used (as compared to 10,000). While more delays and memory can be used by the layered code as compared to a conventional code, the resulting reduction in computation complexity is typically worth this small cost. For example, using the layered code, for each input chip 200 multiply accumulate operations can be performed to obtain the final correlation result (as compared to 10,000 for a conventional correlator)—a reduction factor of over 50.

Of course, layered codes are not limited to two layers, as described herein, nor are they limited to the particular code lengths described above. Various numbers of layers can be used, and differing code lengths can be used for each layer.

Further, while the delays illustrated above are shown as being multiples of integer chip vales, sub-chip delays can also be used, e.g. delays of ½ or ¼ chip time to provide for greater timing resolution and reduced loss.

Summarizing and reiterating to some extent, a technique for distress message transmission using a low probability of unauthorized detection waveform has been developed. The technique uses spread spectrum processing techniques to provide a low probability of unauthorized interception. Layered spreading codes enable simpler implementation, allowing for lower power consumption. Two-way transmission/reception of distress messages and confirmation messages allows for incremental increase in the distress message transmission power level and/or spreading factor, allowing the transmission range to be slowly increased. This can help to maintain a low probability of detection profile for the emergency transceiver user. The emergency transceiver can be packaged in a wearable apparatus, making it convenient to maintain on the user's person. Activation of the emergency unit can be as simple as pressing a panic button, or can require activation using coded patterns to provide enhanced security.

While a number of illustrative applications have been illustrated, many other applications of the presently disclosed techniques may prove useful. Accordingly, the above-referenced arrangements are illustrative of some applications for the principles of the present invention. It will be apparent to those of ordinary skill in the art that numerous modifications can be made without departing from the principles and concepts of the invention as set forth in the claims.

What is claimed is:

1. A method of transmitting an emergency distress signal while maintaining a low probability of detection profile, the method comprising:

detecting an emergency indication at an emergency transmitter;

transmitting a first low probability of detection encoded radio frequency spread-spectrum signal using a first power level and a first spreading factor selected to provide a local communications range, the transmitting being from the emergency transmitter in response to the emergency indication;

waiting a time interval for reception of a confirmation message at the emergency transmitter in response to the first low probability of detection encoded radio frequency spread-spectrum signal;

transmitting a second low probability of detection encoded radio frequency spread-spectrum signal using a second power level wherein the second power level is greater than the first power level to provide an extended communications range if no response signal was received at the emergency transceiver during the time interval, the extended communications range being greater than the local communications range.

2. The method of claim 1, wherein the local communications range corresponds to ground-to-ground communications within a distance of about 5 km and the extended communications range corresponds to ground-to-air communications within a distance of about 500 km.

3. The method of claim 1, further comprising repeating the transmitting a first low probability of detection encoded radio frequency spread-spectrum signal a plurality of times.

4. The method of claim 3, wherein between the repeating the transmitting a first low probability of detection encoded radio frequency spread-spectrum signal the waiting a time interval for reception of a confirmation message uses a variable time interval.

5. The method of claim 4, wherein the variable time interval is varied psuedorandomly.

6. The method of claim 1, further comprising:

waiting a time interval for reception of a confirmation message at the emergency transmitter in response to the second low probability of detection encoded radio frequency spread-spectrum signal;

transmitting a third low probability of detection encoded radio frequency spread-spectrum signal using the second power level and a second spreading factor, wherein the second spreading factor is greater than the first spreading factor to provide a global communications range, wherein the global communications range is greater than the extended communications range.

7. The method of claim 6, wherein the local communications range corresponds to ground-to-ground communications within a distance of about 5 km, the extended communications range corresponds to ground to air communications within a distance of about 500 km, and the global communications range corresponds to ground to space communications within a distance of about 50,000 km.

8. The method of claim 6, further comprising repeating the transmitting a second low probability of detection encoded radio frequency spread-spectrum signal a plurality of times each separated by a different time interval.

9. The method of claim 6, further comprising repeating the transmitting a third low probability of detection encoded radio frequency spread-spectrum signal until a response is received, the repeating the transmitting being separated by a varying time interval.

10. The method of claim 6, wherein the first spreading factor comprises a first chipping rate and a first data rate and the second spreading factor comprises the first chipping rate and a second data rate wherein the second data rate is less than the first data rate.

11. The method of claim 1, wherein the transmitting a first low probability of detection encoded radio frequency spread-spectrum signal comprises performing a direct sequence layered spreading operation; and the transmitting a second low probability of detection encoded radio frequency spread-spectrum signal comprises performing a direct sequence layered spreading operation.

12. The method of claim 1, wherein the detecting an emergency indication at an emergency transmitter comprises operating an actuator according to a predefined authorization sequence.

13. The method of claim 12, wherein the detecting an emergency indication comprises a method selected from the group consisting of activating a push button, activating multiple push buttons simultaneously, activating a watch stem, rotating a watch bezel, and combinations thereof.

14. The method of claim 1, further comprising providing a human-perceivable indication at the emergency transceiver when the response is received.

15. The method of claim 14, wherein providing a human-perceivable indication comprises providing a indication selected from the group consisting of an audible indication, a visible indication, a haptic indication, and combinations thereof.

16. A portable emergency transceiver for search and rescue operations in a hostile environment, the transceiver comprising:

a wearable device;

a transmitter disposed in the wearable device and capable of repeated transmission of a unique unit identification using a low probability of detection radio frequency waveform with a variable power level and a variable spreading factor;

an actuator disposed in the wearable device and operatively coupled to the transceiver to enable transmission from the transmitter when the actuator is operated according to a predefined authorization methodology; and a receiver disposed in the wearable device and operatively coupled to the transmitter and capable of receiving confirmation messages via a radio frequency link, wherein the receiver controls the variable power level and variable spreading factor based on reception and non-reception of confirmation messages.

17. The device of claim 16, wherein the receiver is configured to initiate the transmitter at intervals while increasing the variable power level until a confirmation message is received or a maximum power level is reached.

18. The device of claim 17, wherein once the maximum power level is reached the receiver is further configured to initiate the transmitter at intervals while increasing the variable spreading factor until a confirmation message is received or a maximum spreading factor is reached.

19. The device of claim 16, wherein the receiver is configured to increase at least one of the power level and the spreading factor after a predetermined number of transmissions occurs and no confirmation message is received to successively expand a communication range of the transmitter from a local range, to an extended range, and to a global range.

20. The device of claim 19, wherein the local communications range corresponds to ground-to-ground communications within a distance of about 5 km, the extended communications range corresponds to ground-to-air communications within a distance of about 500 km, and the global communications range corresponds to ground-to-space communications within a distance of about 50,000 km.

21. The device of claim 16, wherein the transmitter is configured to repeat transmissions using a variable time interval.

22. The device of claim 16, wherein the transmitter comprises a direct-sequence layered spreader.

23. The device of claim 16, wherein the unique unit identification is determined based on the predefined authorization methodology.

24. The device of claim 16, wherein the transmitter and receiver operate on a same carrier frequency.

25. The device of claim 16, wherein the actuator comprises a device selected from the group consisting of a push button, a watch stem, a watch bezel, and combinations thereof.

26. The device of claim 16, further comprising a power source selected from the group consisting of a solar panel, a battery, a fuel cell, a kinetic energy converter, and combinations thereof.

27. The device of claim 16, wherein the wearable device comprises an enclosure selected from the group consisting of a pendant, a watch, and combinations thereof.

28. A search and rescue system comprising:

(a) a plurality of emergency transceiver units, each emergency transceiver unit comprising:

(i) a transmitter configured to transmit a distress message comprising a unique unit identification using a low probability of detection radio frequency waveform with a variable power level and a variable spreading factor when actuated; and (ii) a receiver operatively coupled to the transmitter and configured to control the transmitter power level and spreading factor based on the reception and non-reception of confirmation messages in response to the transmitted unique unit identification;

(b) a plurality of rescue transceiver units, each rescue transceiver unit comprising:

(i) a receiver configured to receive a distress message from any one of the plurality of emergency transceiver units; and (ii) a transmitter operatively coupled to the receiver and configured to transmit a confirmation message in response to the reception of a distress message.

29. The system of claim 28, wherein the plurality of rescue transceiver units comprises:

at least one rescue unit disposed on a ground vehicle; and at least one rescue unit disposed on an airborne vehicle.

30. The system of claim 29, wherein at least one of the plurality of rescue transceiver units is configured to receive the distress message via a satellite.

* * * * *